US006651261B1

(12) United States Patent
Leonard et al.

(10) Patent No.: US 6,651,261 B1
(45) Date of Patent: Nov. 25, 2003

(54) TOILET RIM MOUNTED TOILET CLEANER WITH EXTENSION PLATE

(75) Inventors: Stephen B. Leonard, Franksville, WI (US); Kevin Harrity, Oak Creek, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/198,999

(22) Filed: Jul. 19, 2002

(51) Int. Cl.[7] ..... E03D 9/02
(52) U.S. Cl. ..... 4/231
(58) Field of Search ..... 4/231, 227.1, 232

(56) References Cited

U.S. PATENT DOCUMENTS

| | | | | |
|---|---|---|---|---|
| 1,067,472 A | | 7/1913 | Creed | |
| 1,091,265 A | | 3/1914 | Wohlander | |
| 1,880,912 A | | 10/1932 | Duwelius | |
| 3,529,309 A | | 9/1970 | Leavitt et al. | 4/231 |
| 3,537,112 A | | 11/1970 | Goodman | 4/231 |
| 3,604,021 A | | 9/1971 | Nolte, Jr. et al. | 4/231 |
| 3,675,254 A | | 7/1972 | Brownstein | 4/231 |
| 3,736,600 A | | 6/1973 | Drinkwater | 4/231 |
| 3,766,576 A | | 10/1973 | Ancel | 4/231 |
| 3,946,448 A | | 3/1976 | Sioufy | 4/223 |
| 4,096,593 A | | 6/1978 | Vlahakis | 4/109 |
| 4,261,957 A | | 4/1981 | Schimanski | 422/263 |
| 4,301,556 A | | 11/1981 | Schimanski | 4/231 |
| RE32,017 E | | 11/1985 | Hautmann et al. | 4/231 |
| 4,555,819 A | | 12/1985 | Weiss et al. | 4/223 |
| 4,777,670 A | | 10/1988 | Klinkhammer et al. | 4/231 |
| 4,813,084 A | | 3/1989 | Buecheler | 4/231 |
| 6,178,564 B1 | | 1/2001 | Leonard et al. | 4/223 |
| 6,230,334 B1 | | 5/2001 | Camp et al. | 4/231 |
| 6,389,610 B1 | | 5/2002 | Hautmann et al. | 4/231 |
| 6,505,356 B1 | * | 1/2003 | Leonard et al. | 4/231 |

FOREIGN PATENT DOCUMENTS

| | | | | |
|---|---|---|---|---|
| EP | 538957 | | 4/1993 | |
| EP | 785315 | | 7/1997 | |
| EP | 0878586 | * | 9/1999 | ..... E03D/9/03 |
| EP | 1026331 | | 8/2000 | |
| EP | 1072728 | | 1/2001 | |
| EP | 1182303 | | 2/2002 | |
| FR | 2647483 | | 11/1990 | |
| WO | 90/10122 | | 9/1990 | |
| WO | 99/66139 | | 12/1999 | |
| WO | 99/66140 | | 12/1999 | |
| WO | 00/32883 | | 6/2000 | |
| WO | 00/42261 | | 7/2000 | |
| WO | 01/02653 | | 1/2001 | |
| WO | 01/04428 | | 1/2001 | |
| WO | 01/06067 | | 1/2001 | |
| WO | 01/31128 | | 5/2001 | |
| WO | 01/32995 | | 5/2001 | |
| WO | 01/44589 | | 6/2001 | |
| WO | 01/77451 | | 10/2001 | |
| WO | 01/88286 | | 11/2001 | |

OTHER PUBLICATIONS

Cling Clip–On Toilet Bowl Cleaner and Deodorizer, Reckitt Benckiser (2001) (photos attached).

* cited by examiner

*Primary Examiner*—Kevin Shaver
*Assistant Examiner*—Anuradha Ramana

(57) ABSTRACT

A device for dispensing liquid toilet bowl treatment preparations from under the rim of a toilet bowl by way of the flow of water during a toilet flush is disclosed. The device comprises a bottle that holds a liquid and a base that is suspended from the toilet rim and holds the bottle. The base has a piercing post for opening a closure of the bottle. A wicking device that is supported by the base conveys the liquid from the bottle to a dispensing position within the flow of flush water. An extension plate is removably secured to the base or wicking device. The extension plate is dimensioned such that the extension plate is positioned within the flow of water during a toilet flush and such that at least a portion of the flow of water is directed onto the dispensing position of the wicking device during a toilet flush.

18 Claims, 9 Drawing Sheets

FIG. 1
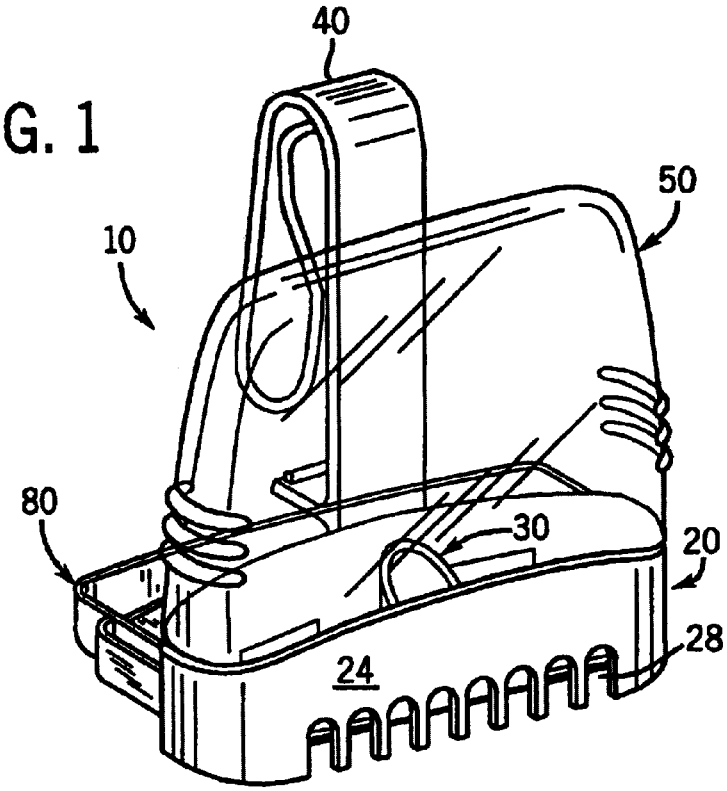
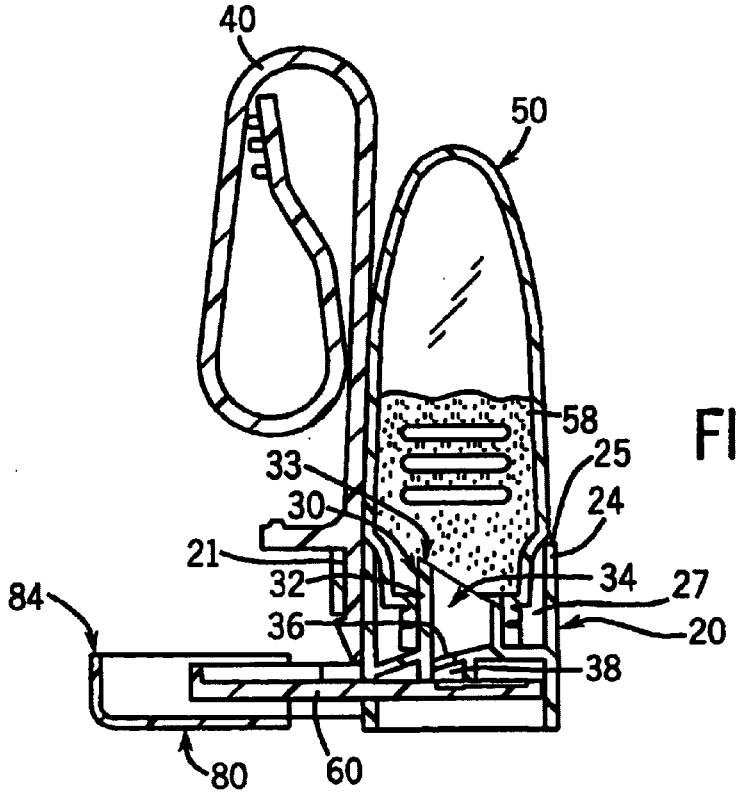
FIG. 2

TOILET RIM MOUNTED TOILET CLEANER WITH EXTENSION PLATE

CROSS-REFERENCES TO RELATED APPLICATIONS

Not Applicable.

STATEMENT REGARDING FEDERALLY SPONSORED RESEARCH

Not Applicable.

BACKGROUND OF THE INVENTION

1. Field of the Invention

This invention relates to liquid dispensers, and in particular to devices for dispensing cleaning and freshening liquids from under the rim of a toilet bowl.

2. Description of the Related Art

Toilet bowls require care to prevent the buildup of unsightly deposits, to reduce odors and to prevent bacteria growth. Traditionally, toilet bowls have been cleaned, deodorized and disinfected by manual scrubbing with a liquid or powdered cleaning and sanitizing agent. This task has required manual labor to keep the toilet bowl clean.

In order to eliminate the manual scrubbing, various automatic continuous cleaning toilet bowl cleaning products have been proposed. One type of product comprises a solid block or solid particles of a cleansing and freshening substance that is suspended from the rim of a toilet bowl in a container that is placed in the path of the flushing water. U.S. Pat. No. 4,777,670 shows an example of this type of toilet bowl cleaning system. Typically, a portion of the solid block is dissolved in the flush water with each flush, and the flush water having dissolved product is dispensed into the toilet bowl for cleaning the bowl. These solid block toilet cleaning systems have certain disadvantages such as a short lifetime and a decline in the amount of cleaning and deodorizing agents released into the toilet bowl as the solid block deteriorates.

Other automatic, continuous cleaning, toilet bowl cleaning systems use a liquid cleaning agent that is dispensed into a toilet bowl. For example, European Patent Application Nos. EP-0538957 and EP-0785315, U.S. Pat. Nos. 6,178,564 B1 and 6,230,334 B1, and PCT International Publication Nos. WO 99/66139 and WO 99/66140 all disclose cleansing and/or freshening devices capable of being suspended from the rim of a toilet bowl for the purpose of introducing liquid active substances from a bottle into the flushing water with each flush. Typically, the liquid active substances may include one of more of the following: surfactants (such as a mixture of an anionic surfactant and a nonionic surfactant), solvents, sequesterants, pH controllers, thickeners, preservatives, fragrances, and dyes. In these under the toilet rim devices, the liquid active substances are delivered from a reservoir to a wicking device (e.g., a dispensing plate or porous mass) that is supported by a base that is suspended from the toilet rim. The device is suspended from the toilet rim such that the flow of flush water from the toilet contacts the wicking device during a flush. The flush water carries the liquid active substances that are on the wicking device into the toilet bowl to clean and freshen the toilet.

One problem with the known under the toilet rim liquid cleansing and/or freshening devices is that these units do not generally have the design flexibility needed in order to fit the wide variety of toilet types and sizes available worldwide. In particular, these devices may not be configured such that the toilet flush water is able to contact the wicking device upon flushing. For example, when certain under the toilet rim liquid cleansing and/or freshening devices are suspended from toilets having wide rims, the wicking device is not arranged underneath the flush water path which typically is adjacent the inner wall of the toilet bowl. As a result, the flush water cannot contact the wicking device and carry the liquid active substances that are on the wicking device into the toilet bowl to clean and freshen the toilet.

Two solutions to this problem have been proposed. In WO 99/66140, the under the toilet rim cleansing and freshening device includes a movable wicking device that can slide out such that the wicking device is positioned in the path of the flush water when the device is mounted in a toilet having a wide rim. When used in a toilet having a narrower rim, the wicking device is slid back into the device. While this device is very effective, it requires specialized connecting means on the mounting base and the wicking device. This specialized connecting means may increase manufacturing costs. U.S. Pat. No. 6,230,334 B1 proposes another solution wherein the mounting structure of the under the toilet rim cleansing and freshening device includes a foldable plate-like element that extends outward from the mounting structure. When the device is suspended from the toilet rim, the foldable plate-like element is supported by the inner wall of the toilet bowl. While this device provides advantages when used with toilet bowls having a wide rim, the extra foldable plate-like element cannot be removed or moved into a non-obtrusive position when used on narrower toilet rims that do not require an extension element. As a result, this device may misdirect flush water away from the wicking device (and the liquid active substances contained thereon) when used with narrower toilet rims. In addition, it has been discovered that the performance of under the toilet rim liquid cleansing and/or freshening devices can be improved when the wicking device is inclined downward toward the toilet bowl. The foldable plate-like element that extends outward from the mounting structure of the device in U.S. Pat. No. 6,230,334 B1 makes it impossible to introduce an advantageous incline into the wicking device when the device is mounted on a toilet rim.

Therefore, there is a need for an improved device that can dispense quantities of cleaning and freshening liquids from under the rim of a toilet bowl during a flush. In particular, there is a need for an under the toilet rim liquid cleansing and/or freshening device that includes an extension plate that may be added to the device such that the toilet flush water may be collected and directed over a wicking device regardless of the toilet configuration thereby effectively washing the cleaning and freshening liquids off the wicking device and into the toilet bowl. Furthermore, there is a need for an under the toilet rim liquid cleansing and/or freshening device that includes an extension plate that may be added to the device such that the wicking device is inclined downwardly toward the inner wall of the toilet bowl when installed on the toilet rim thereby optimizing device performance.

BRIEF SUMMARY OF THE INVENTION

The foregoing needs are met by a dispensing device according to the invention in which a flow of water during a toilet flush is used to dispense toilet bowl treatment liquids into a toilet bowl. The dispensing device includes a bottle, a base, means for suspending the base from a rim of a toilet bowl, a wicking device, and an extension plate. The bottle holds a liquid, and has a mouth and a closure for covering the mouth. The base holds the bottle, and has a piercing post that is suitable for opening the closure of the bottle. The wicking device is supported by the base, and is suitable to convey the liquid from the piercing post to a dispensing position on the wicking device. The extension plate is removably secured to the wicking device, and is dimensioned such that the extension plate is positioned within the flow of water during a toilet flush and such that at least a portion of the flow of water is directed onto the dispensing position of the wicking device during a toilet flush.

In another embodiment of the invention, the extension plate is removably secured to the base, and is dimensioned such that the extension plate is positioned within the flow of water during a toilet flush and such that at least a portion of the flow of water is directed onto the dispensing position of the wicking device during a toilet flush.

The wicking device of a dispensing device according to the invention may comprise any number of different wicking structures including a dispensing plate having an upper surface including at least one feed channel in fluid communication with the piercing post of the base, a plate with holes formed therein, or a porous pad.

The removable extension plate can be secured to the wicking device or the base by a snap fit engagement. The removable extension plate can also be secured to the wicking device or the base by inserting an edge of the wicking device or an edge of the base in a channel in an inner wall of the extension plate. In one form, the removable extension plate is dimensioned and secured to the wicking device or the base such that the wicking device is inclined downwardly with respect to an inner wall of the toilet bowl when the dispenser is installed on the rim of the toilet bowl. The removable extension plate may include an upwardly extending rim at a perimeter thereof to assist in the collection and distribution of toilet flush water. Preferably, the extension plate is fixed against rotational movement with respect to the wicking device or the base when secured to the wicking device or base. Most preferably, the extension plate is fixedly positioned in the same plane as the wicking device.

The removable extension plate provides the design flexibility such that an existing under the toilet rim liquid cleansing and freshening device can be modified in order to fit the wide variety of toilet types and sizes on the worldwide market. This allows for under the rim cleaning of differing toilet types and sizes without the need for numerous specialized under the toilet rim liquid cleaning device configurations for each toilet. The removable extension plate can be secured to an existing under the toilet rim liquid cleansing device in order to expand the fit of the existing device into the vast majority of toilets in the market globally. By adding the removable extension plate, the toilet flush water can be collected and directed over the wicking device thereby effectively washing the cleaning/freshening liquid off the wicking device. Toilets where the wicking device was not in the flow of toilet flush water (thereby rendering the under the toilet rim liquid cleansing and/or freshening device useless) are now accommodated.

The removable extension plate also provides additional structure to the overall under the toilet rim liquid cleansing and/or freshening device thereby inducing a tilt (or downward inclination) to the wicking device when installed on certain toilets. This tilt improves the fluid delivery performance of the device when installed on a toilet.

It is therefore an advantage of the present invention to provide an improved device that can dispense quantities of cleaning and freshening toilet bowl treatment liquids from under the rim of a toilet bowl during a flush.

It is another advantage of the present invention to provide an under the toilet rim liquid cleansing and/or freshening device that includes an extension plate that may be added to the device such that toilet flush water may be collected and directed over a wicking device regardless of the toilet configuration thereby effectively washing the cleaning and freshening liquids off the wicking device and into the toilet bowl.

It is yet another advantage of the present invention to provide an under the toilet rim liquid cleansing and/or freshening device that includes an extension plate that may be added to the device such that the wicking device is inclined downwardly toward the inner wall of the toilet bowl when installed on the toilet rim thereby optimizing device performance.

It is still another advantage of the present invention to provide an under the toilet rim liquid cleansing and/or freshening device that includes an extension plate that may be added to the device such that the device may work effectively in the vast majority of toilets marketed worldwide.

BRIEF DESCRIPTION OF THE DRAWINGS

These and other features, aspects, and advantages of the present invention will become better understood upon consideration of the following detailed description, appended claims, and drawings where:

FIG. 1 is a perspective view of a first embodiment of a dispenser in accordance with the invention.

FIG. 2 is a vertical cross-sectional view of the dispenser shown in FIG. 1.

Like reference numerals will be used to refer to like or similar parts from Figure to Figure in the following description of the invention.

DETAILED DESCRIPTION

Figure 14:
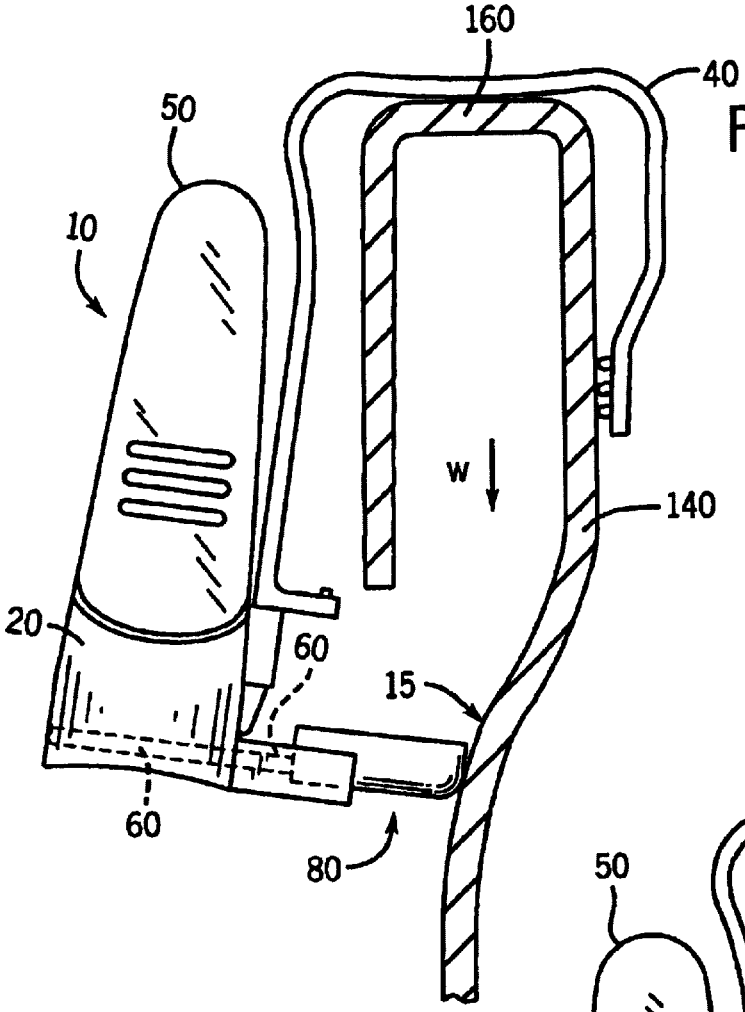
FIG. 14 is a side view showing the first embodiment of the dispenser shown in FIG. 1 installed on an open rim type toilet bowl.
Figure 15:
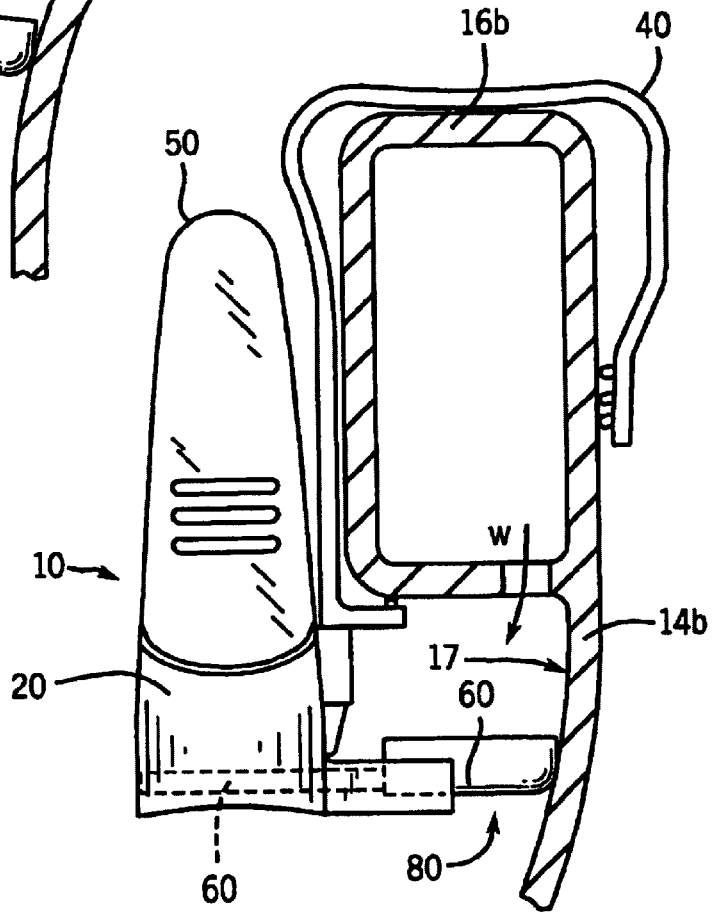
FIG. 15 is a view similar to FIG. 14, but with the first embodiment of the dispenser shown in FIG. 1 installed on a box rim type toilet bowl.

Referring to FIGS. 1 to 8, 12, 14 and 15, there is shown a first embodiment of a liquid dispenser 10 for dispensing liquid toilet bowl treatment preparations from the rim of a toilet bowl. The dispenser 10 includes a base 20, a sprung suspension hook 40 for suspending the base 20 from the rim of a toilet bowl (as shown in FIGS. 14 and 15), a reservoir bottle 50 containing a liquid 58, a wicking device 60 that is supported by the base 20, and a removable extension plate 80 that is secured to the wicking device 60. The liquid 58 used in the bottle 50 may be any liquid formula having the cleaning, foaming, disinfecting and fragrancing characteristics required for the specific toilet cleaning application. One example liquid 58 comprises an anionic surfactant, a non-ionic surfactant, a solvent, a sequesterant, a base to control pH, a thickener, a preservative, a fragrance, and a dye. Another example liquid is disclosed in European patent application no. EP 775,741 and comprises 1–25 wt. % perfume, 10–50 wt. % anionic or non-ionic surfactant, 1–20 wt. % evaporation regulator, and balance solvent. Once the liquid dispenser 10 is suspended from a toilet bowl such as that shown in FIGS. 14 and 15, a user inserts a sealed inverted reservoir bottle 50 into the base 20. The act of insertion causes a seal on the reservoir bottle 50 to break, in a manner to be described below. A wicking device 60, which may be in the form of a dispensing plate or a porous pad, is located within the base 20, and this wicking device 60 conveys by capillary action the liquid 58 from the reservoir bottle 50 to a position within the stream of flushing water within the toilet bowl.

While a variety of materials may be used to form the base 20, the suspension hook 40, the bottle 50, and the extension plate 80, it is preferable to manufacture these components from a thermoplastic material such as polyethylene or polypropylene. Typically, the base 20, the suspension hook 40 and the extension plate 80 comprise an opaque thermoplastic material such as pigmented polyethylene or polypropylene, and the bottle 50 comprises a transparent thermoplastic material such as clear polyethylene or polypropylene. For ease of manufacture, the suspension hook 40 is formed as a separate component from the base 20, and the base 20 is formed with an integral guide channel 21 (see FIG. 2) of rectangular cross-section into which the lower end of the suspension hook 40 is inserted during assembly. The lower end of the suspension hook 40 comprises a raised, chamfered portion 42, such that, upon insertion, the hook 40 remains engaged within the channel 21 by a snap-fitting arrangement.

The base 20 includes a side wall 24 that terminates at an upper edge 25. The side wall 24 and the upper edge 25 create a mounting structure that holds the bottle 50 when the bottle 50 is installed on the base 20. The inner surface of the side wall 24 may also include ribs to further retain the bottle 50 in the base 20. In an inner central portion of the base 20, as best shown in FIG. 2, there is provided an annular channel 27 that runs adjacent a piercing post 30 that is used to carry fluids from the bottle 50 when the liquid dispensing device 10 is installed on a toilet rim. The base 20 is also formed with a series of drain slots 28 (best shown in FIG. 5) at the bottom of the front side which allow the flushing water to drain away from above the wicking device 60.

Figure 3:
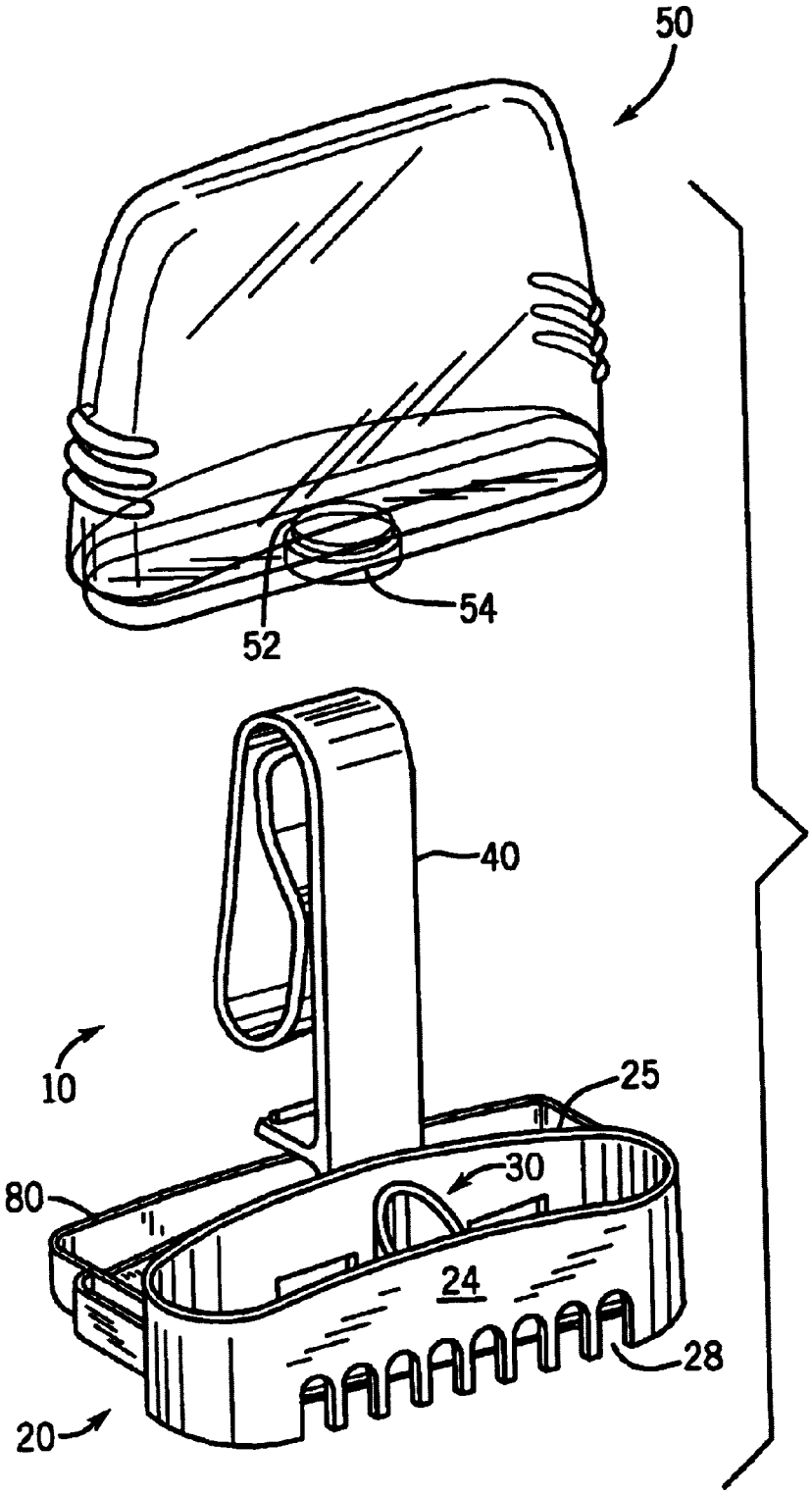
FIG. 3 is an exploded perspective view of the dispenser shown in FIG. 1.
Figure 5:
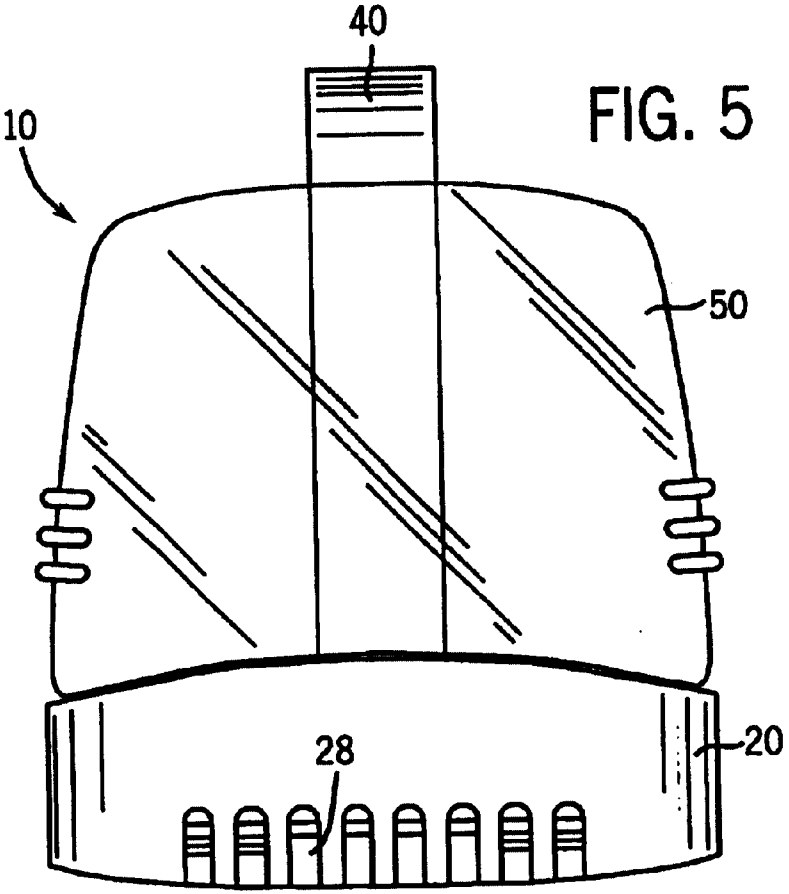
FIG. 5 is a front view of the dispenser shown in FIG. 1.
Figure 4:
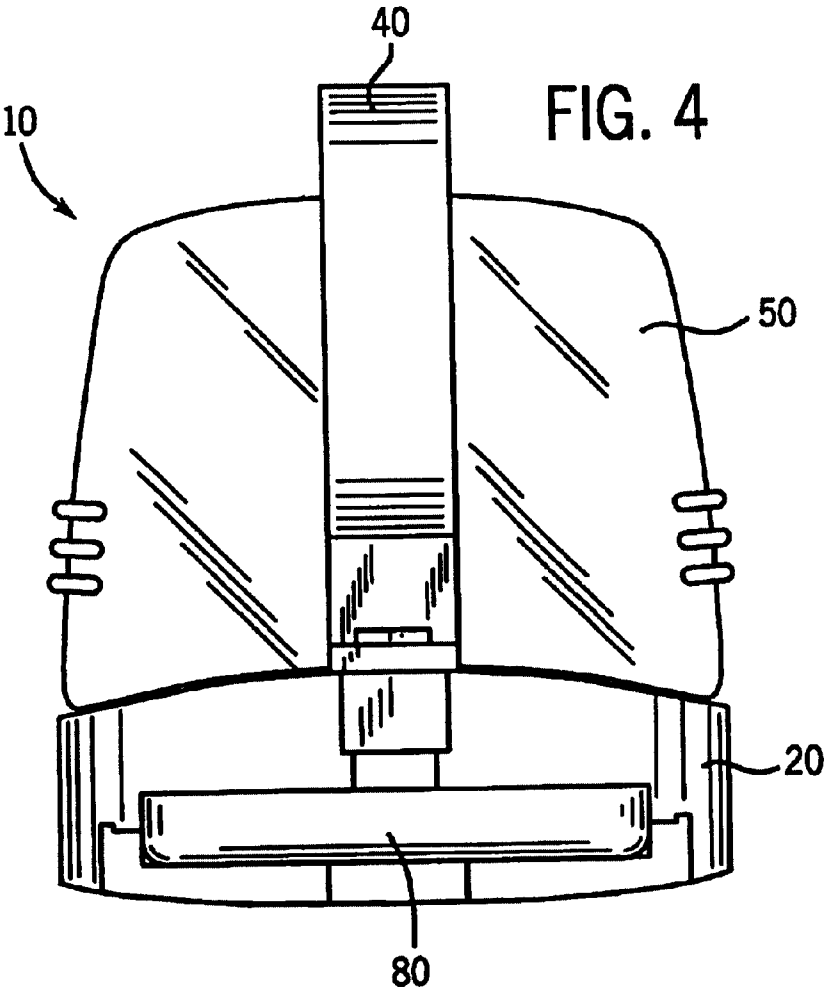
FIG. 4 is a rear view of the dispenser shown in FIG. 1.

The installation of the bottle 50 on the base 20 is best shown in FIGS. 2 and 3. The piercing post 30 of the base 20 comprises a cylindrical tubular section 32 that defines a feed conduit 34. An upper end 33 of the tubular section 32 terminates obliquely to form an elliptical mouth. The bottle 50 includes a circular mouth 52 that is covered by a closure 54 that seals the liquid 58 in the bottle 50 for shipment and storage. In the version of the bottle shown in the FIG. 3, the closure 54 is a thermoplastic cap with a channel that engages a circular flange at the mouth 52 of the bottle 50. Other closures, such as foil or plastic film, would also be suitable for sealing the mouth 52 of the bottle 50. The central portion of the closure 54 shown in FIG. 3 has a frangible seal with a circular area of reduced thickness.

During installation, the inverted bottle 50 is oriented over the piercing post 30 of the base 20 such that the circular inner wall of the closure 54 approximately lines up with the circular outer surface of the piercing post 30, and the bottle is moved in a downward direction until the upper end 33 of the piercing post 30 causes the circular area of the frangible seal to fracture. The feed conduit 34 of the base 20 is then placed in fluid communication with the mouth 52 of the bottle 50 and liquid 58 may flow from the bottle 50 through the feed conduit 34 and out of a dispensing hole 36 at the bottom of the piercing post 30 by way of gravity. By properly dimensioning the piercing post 30 and the closure 54 and the mouth 52 of the bottle 50, a fluid tight seal is formed when the bottle is installed on the base 20. The base 20 further comprises an outlet portion 38 in the form of a cylinder which bears against the wicking device 60.

Figure 8:
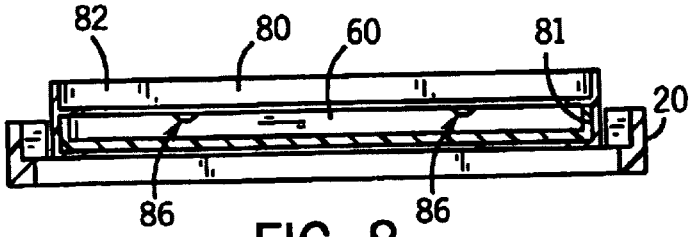
FIG. 8 is a partial cross-sectional view taken along line 8—8 in FIG. 7 showing the means for attaching the extension plate to the wicking device of the dispenser shown in FIG. 1.
Figure 9:
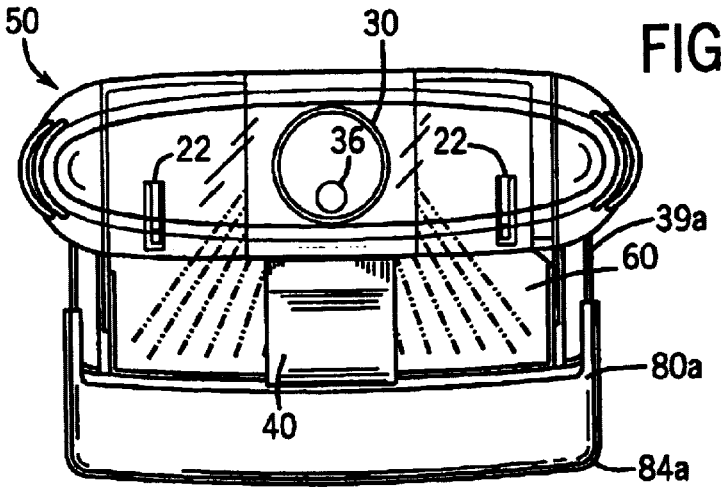
FIG. 9 is a top plan view of a second embodiment of a dispenser according to the invention having an alternative extension plate.
Figure 10:
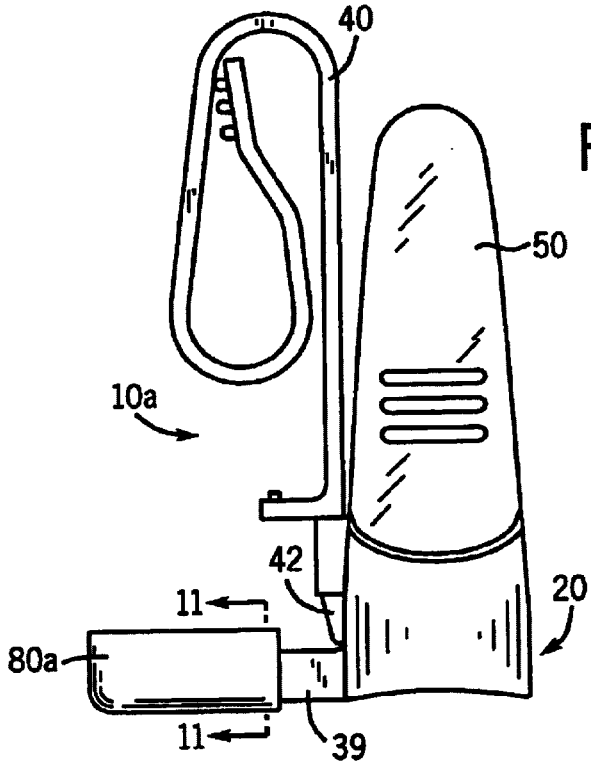
FIG. 10 is a side view of the dispenser shown in FIG. 9, the other side view being a mirror image.
Figure 11:
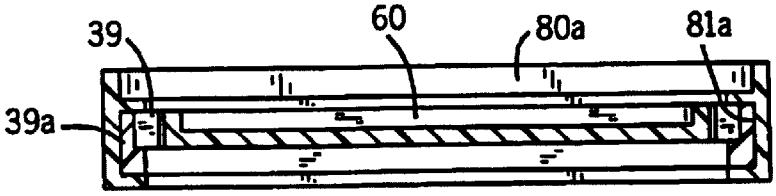
FIG. 11 is a partial cross-sectional view taken along line 11—11 in FIG. 10 showing the means for attaching the alternative extension plate to the wicking device of the dispenser shown in FIG. 10.
Figure 12:
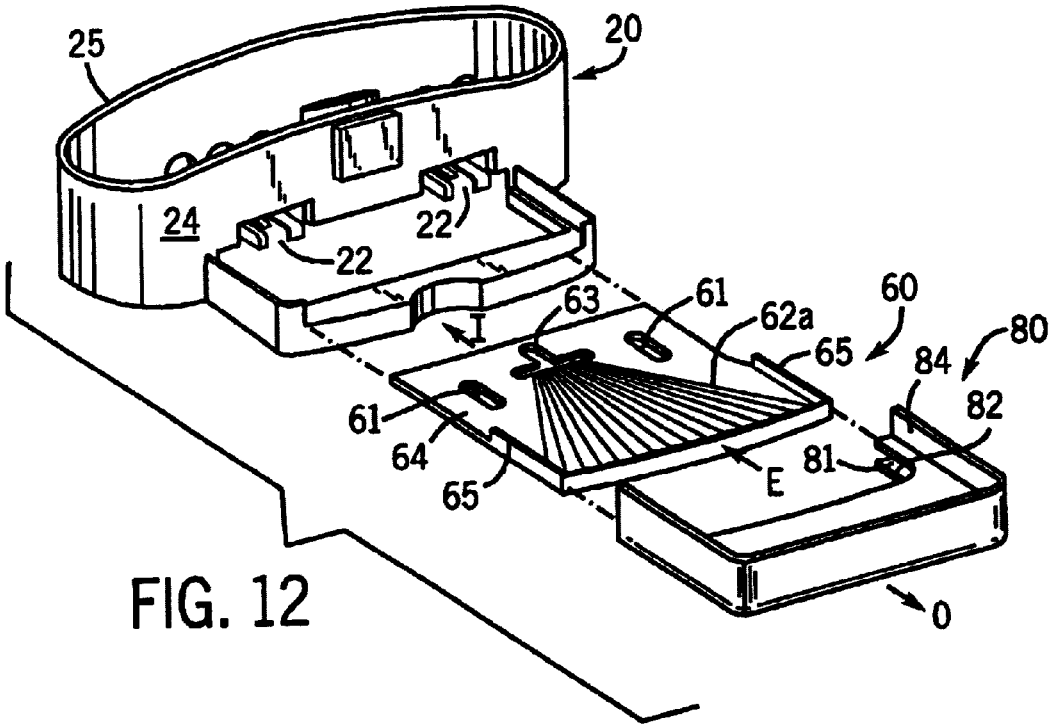
FIG. 12 illustrates schematically the manner in which a wicking device may be inserted into the base of the first embodiment of the dispenser shown in FIG. 1 and in which an extension plate may be attached to the wicking device.

The manner in which the wicking device 60 is installed in the base 20 and the manner in which the extension plate 80 is secured to the wicking device 60 are illustrated in FIGS. 8 and 12. The wicking device 60 is provided with two elongate guide slots 61 which are engaged by two corresponding spring fingers 22 in the base 20. The wicking device 60 in moved in the direction of arrow I in FIG. 12 until the guide slots 61 are engaged by the spring fingers 22. The guide slots 61 serve to define the two extreme positions of the range of possible positions of the wicking device 60 within the base 20. The extension plate 80 is provided with a channel 81 in an inner wall 82 of the extension plate 80. The extension plate 80 is moved in the direction of arrow E in FIG. 12 until an edge 65 of the wicking device 60 is inserted in the channel 81 in the inner wall 82 of the extension plate 80. An interference fit between the edge 65 of the wicking device 60 and the channel 81 in the inner wall 82 of the extension plate 80 (best shown in FIG. 8) serves to keep the extension plate 80 secured to the wicking device 60. However, the extension plate 80 may be removed from the wicking device 60 by pulling the extension plate 80 in direction O in FIG. 12. Optionally, the inner wall 82 of the extension plate 80 includes projections 86 (best shown in FIG. 8) that provide a snap fit engagement between the wicking device 60 and the extension plate 80. Alternatively, additional projections may be provided on the extension plate 80 such that a snap fit engagement between the extension plate 80 and the base 20 occurs. The extension plate 80 may also include an upwardly extending rim 84 at a perimeter thereof.

Figure 6:
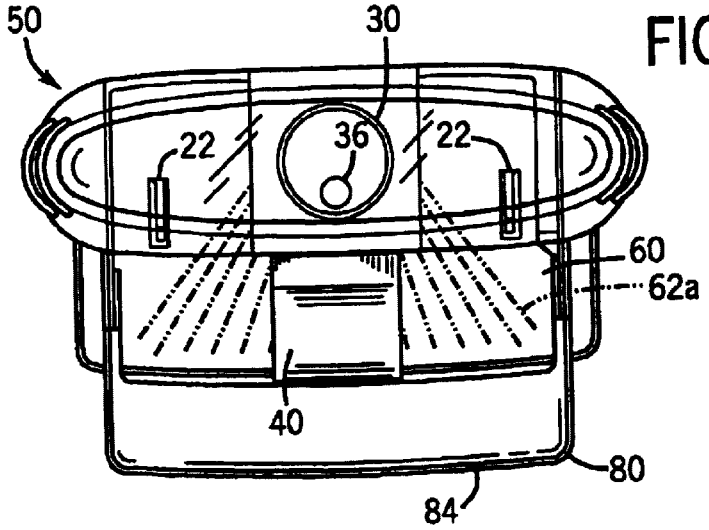
FIG. 6 is a top plan view of the dispenser shown in FIG. 1.
Figure 7:
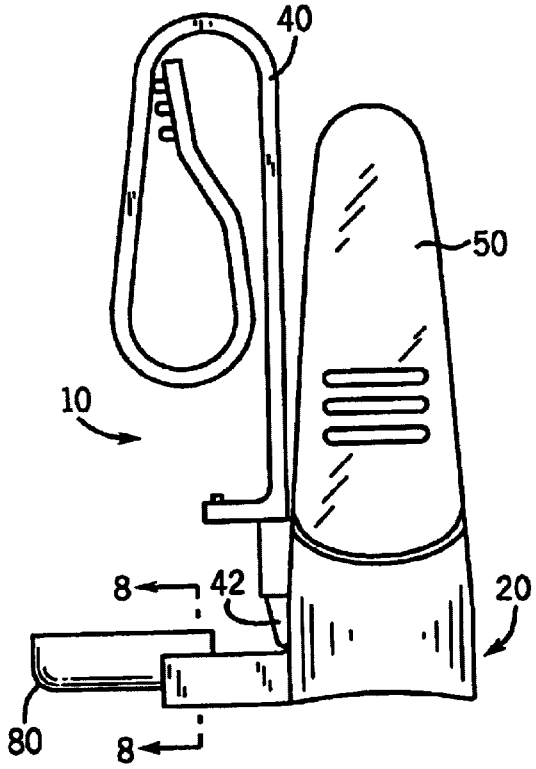
FIG. 7 is a side view of the dispenser shown in FIG. 1, the other side view being a mirror image.
Figure 18:
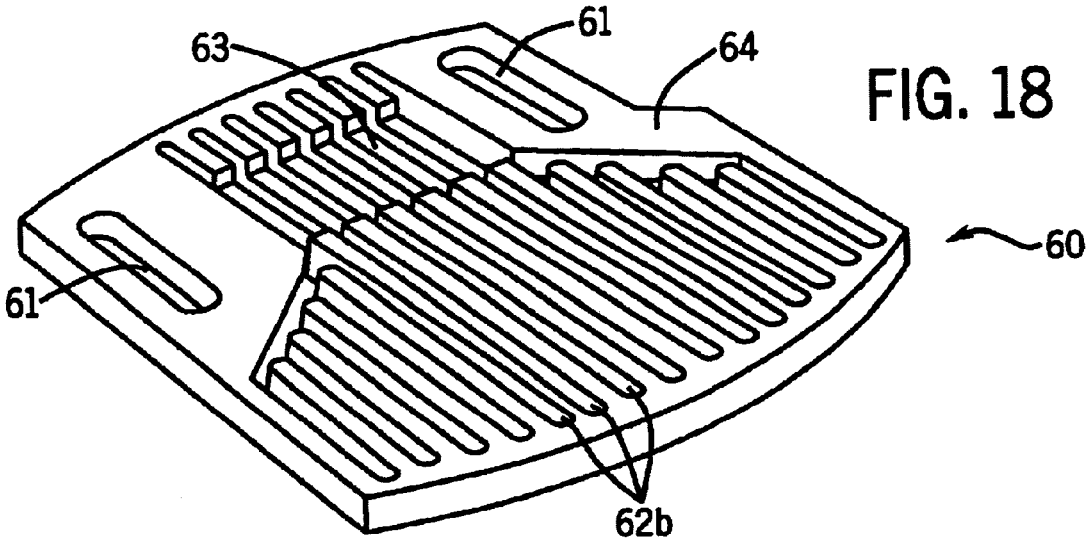
FIG. 18 is a perspective view of a wicking device that may be inserted into the base of the dispenser shown in FIG. 1 or FIG. 9.

Looking at FIGS. 6 and 12, the wicking device 60 may be a dispensing plate including capillary feed channels 62*a* that are arranged in radiating fashion in the top surface of a non-porous plate 64. Looking at FIG. 18, the wicking device 60 may be also be a dispensing plate including capillary feed channels 62*b* that are arranged in parallel fashion in the top surface of the non-porous plate 64. A recess 63 is formed within the wicking device 60 to accommodate fluid from the inverted reservoir bottle 50. The wicking device 60 is attached to the base 20 such that the recess 63 of the wicking device 60 is placed in fluid communication with the feed conduit 34 of the base 20. In the version of the wicking device 60 shown in FIG. 2, the outlet portion 38 at the bottom of the piercing post 30 is used to provide a fluid path between feed conduit 34 and the recess 63 of the wicking device 60. As a result of this configuration, liquid flows out of the bottle 58, into the feed conduit 34 of the base 20, through the outlet portion 38 and into the recess 63 of the wicking device 60. Liquid 58 then flows from the recess 63 of the wicking device 60 into the capillary feed channels 62*a* or 62*b* in the upper surface of the wicking device 60. The liquid then continues to move toward the outer end of the capillary feed channels 62*a* or 62*b* where the liquid is mixed with flush water. Various means can be used to move the liquid from the recess 63 of the wicking device 60 into the capillary feed channels 62*a* or 62*b*. For example, the capillary action provided by adherence of the fluid to the sides of the capillary feed channels 62*a* or 62*b* serves to move the liquid toward the outer end of the capillary channels 62*a* or 62*b*. After the flushing water washes liquid from the wicking device 60 into the toilet water, a fresh supply of liquid 58 is distributed from the bottle 58 to the wicking device 60 as described above.

FIG. 14 illustrates the configuration of the dispensing device 10 when used with a toilet 140 with an open rim. With the dispensing device 10 suspended from the rim 160 of such a toilet 140, it can be seen that the stream of flushing water, indicated by the arrow W, contacts the extension plate 80. When used with a toilet 14*b* of the boxed-rim configuration, as shown in FIG. 15, the stream of flushing water, indicated by the arrow W, also contacts the extension plate 80. The extension plate 80 is dimensioned such that the extension plate 80 is positioned within the flow of water during a toilet flush.

Having described the structure of the dispenser 10, the operation of the dispenser 10 can be explained further. After the bottle 50 is installed in the base 20 of the dispenser 10 as described above, and the dispenser 10 is installed on a toilet bowl rim as described above with reference to FIGS. 14 and 15, the dispenser 10 is ready for operation. The liquid 58 flows out of the bottle 50, into the feed conduit 34 of the base 20, through the outlet portion 38 and onto the wicking device 60. Liquid 58 then flows toward the outer end of the wicking device 60 by way of capillary action of the capillary channels 62*a* or 62*b* as described above. When the toilet is flushed, the flow of flush water contacts the extension plate 80, and the flush water is directed onto the outer end of the wicking device 60. The liquid 58 on the wicking device 60 is mixed with flush water, and a mixture including flush water and liquid 58 is then distributed into the toilet. After the flushing water washes liquid 58 from the wicking device 60 into the toilet water, a fresh supply of liquid 58 is distributed from the bottle to the wicking device 60 as described above. The fresh supply of liquid 58 is then available for the next toilet flush.

Figure 16:
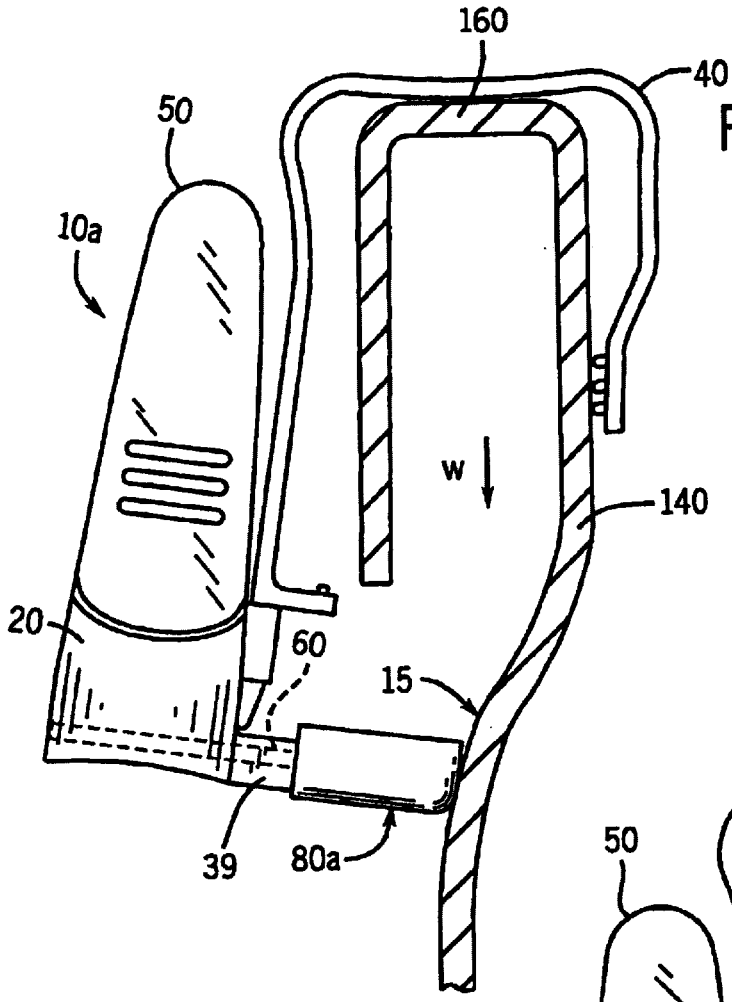
FIG. 16 is a side view showing the second embodiment of the dispenser shown in FIG. 9 installed on an open rim type toilet bowl.
Figure 17:
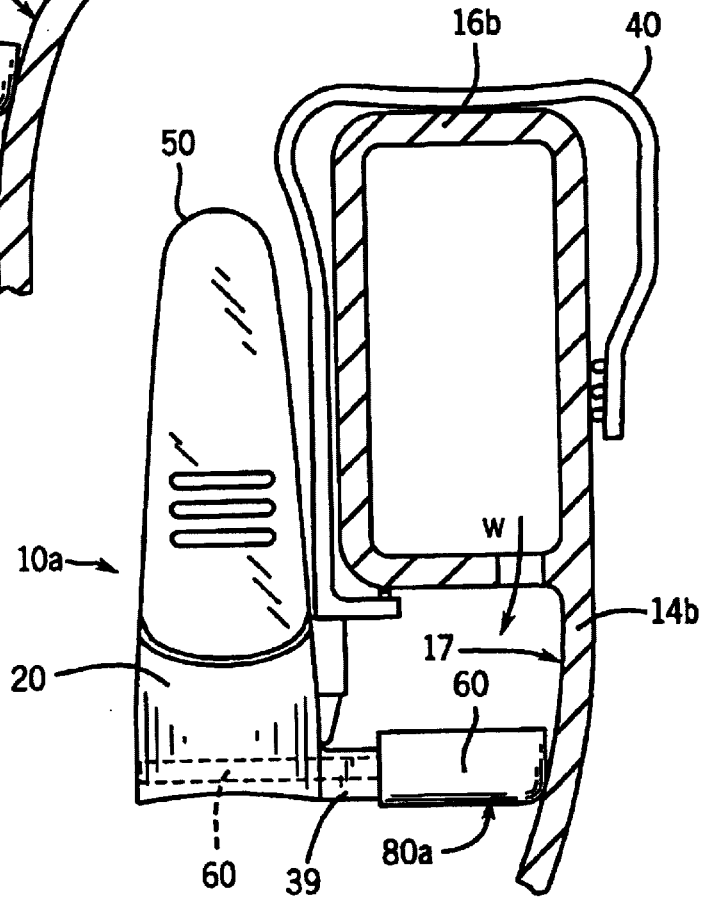
FIG. 17 is a view similar to FIG. 16, but with the second embodiment of the dispenser installed on a box rim type toilet bowl.

Referring now to FIGS. 9–11, 13, 16 and 17, there is shown a second embodiment of a liquid dispenser 10*a* for dispensing liquid toilet bowl treatment preparations from the rim of a toilet bowl. The dispenser 10*a* includes a base 20 (as described above), a sprung suspension hook 40 (as described above) for suspending the base 20 from the rim of a toilet bowl (as shown in FIGS. 16 and 17), a reservoir bottle 50 (as described above) containing a liquid 58 (as described above), a wicking device 60 (as described above) that is supported by the base 20, and a removable extension plate 80*a* that is secured to a support structure 39 that is integral with the base 20. The bottle 50 is installed on the base 20 of the dispenser 10*a* as described above for the first embodiment of the dispenser 10.

Figure 13:
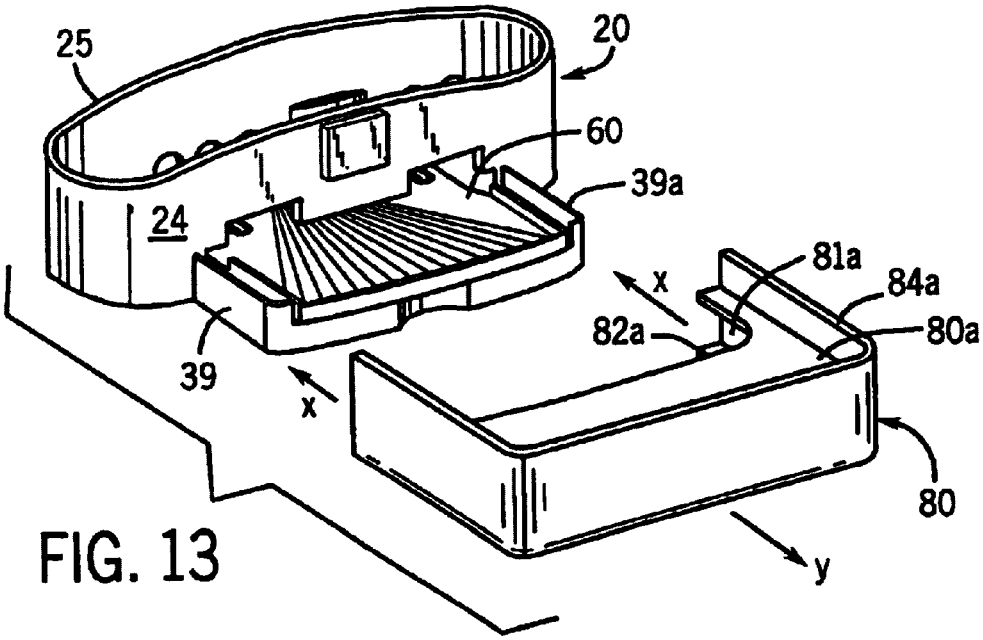
FIG. 13 illustrates schematically the manner in which the alternative extension plate may be attached to the base of the second embodiment of the dispenser shown in FIG. 9.

The manner in which the extension plate 80*a* is secured to the support structure 39 of the base 20 is illustrated in FIG. 13. The extension plate 80*a* is provided with a channel 81*a* in an inner wall 82*a* of the extension plate 80*a*. The extension plate 80*a* is moved in the direction of arrows X in FIG. 13 until an edge 39*a* of the support structure 39 of the base 20 is inserted in the channel 81*a* in the inner wall 82*a* of the extension plate 80*a*. An interference fit between the edge 39*a* of the support structure 39 of the base 20 and the channel 81*a* in the inner wall 82*a* of the extension plate 80*a* (best shown in FIG. 11) serves to keep the extension plate 80*a* secured to the edge 39*a* of the support structure 39 of the base 20. However, the extension plate 80*a* may be removed from the edge 39*a* of the support structure 39 of the base 20 by pulling the extension plate 80*a* in direction Y in FIG. 13. Optionally, the inner wall 82*a* of the extension plate 80*a* includes projections that provide a snap fit engagement between the edge 39*a* of the support structure 39 of the base 20 and the extension plate 80*a*. The extension plate 80*a* may also include an upwardly extending rim 84*a* at a perimeter thereof.

FIG. 16 illustrates the configuration of the dispensing device 10*a* when used with a toilet 140 with an open rim. With the dispensing device 10*a* suspended from the rim 160 of such a toilet 140, it can be seen that the stream of flushing water, indicated by the arrow W, contacts the extension plate 80*a*. When used with a toilet 14*b* of the boxed-rim configuration, as shown in FIG. 17, the stream of flushing water, indicated by the arrow W, also contacts the extension plate 80*a*. The extension plate 80*a* is dimensioned such that the extension plate 80*a* is positioned within the flow of water during a toilet flush.

Having described the structure of the dispenser 10*a*, the operation of the dispenser 10*a* can be explained further. After the bottle 50 is installed in the base 20 of the dispenser 10*a* as described above, and the dispenser 10*a* is installed on a toilet bowl rim as described above with reference to FIGS. 16 and 17, the dispenser 10*a* is ready for operation. The liquid 58 flows out of the bottle 50, into the feed conduit 34 of the base 20, through the outlet portion 38 and onto the wicking device 60. Liquid 58 then flows toward the outer end of the wicking device 60 by way of capillary action of the capillary channels 62*a* or 62*b* as described above. When the toilet is flushed, the flow of flush water contacts the extension plate 80*a*, and the flush water is directed onto the outer end of the wicking device 60. The liquid 58 on the wicking device 60 is mixed with flush water, and a mixture including flush water and liquid 58 is then distributed into the toilet. After the flushing water washes liquid 58 from the wicking device 60 into the toilet water, a fresh supply of liquid 58 is distributed from the bottle to the wicking device 60 as described above. The fresh supply of liquid 58 is available for the next toilet flush.

Figure 19:
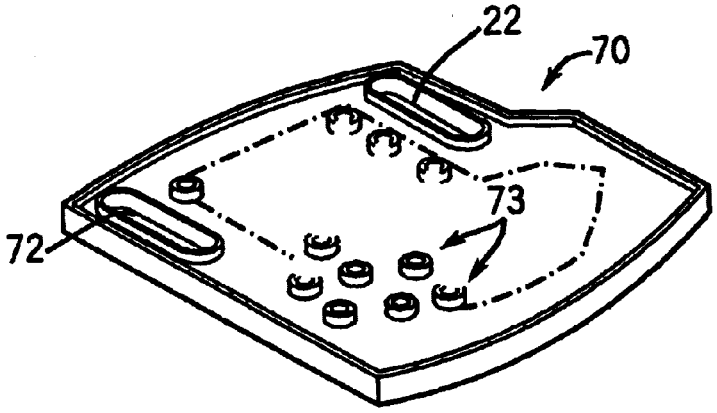
FIG. 19 is a perspective view of another version of a wicking device that may be inserted into the base of the dispenser shown in FIG. 1 or FIG. 9.

Turning now to FIG. 19, there is shown a perspective view of an alternative structure of the wicking device. The wicking device is in the form of a dispensing plate 70 having the same overall shape as the wicking device 60 that is illustrated in FIGS. 1–18, with elongate guide slots 72 that provide adjustability of position of the plate 70. In this embodiment of the wicking device, the plate 70 is solid apart from a number of raised through-holes 73 formed in the plate. In operation of a dispenser having this plate 70, liquid 58 flows out of the bottle 58, into the feed conduit 34 of the base 20, through the outlet portion 38 and onto the plate 70. When the toilet is flushed, the liquid 58 is mixed with flush water as described above. A mixture including flush water and liquid is then distributed into the toilet through through-holes 73 in the plate 70. The through-holes 73 are sufficiently small to prevent the undiluted liquid 58 from passing through. After the flushing water washes liquid through through-holes 73 in the plate 70 into the toilet water, a fresh supply of liquid 58 is distributed from the bottle 50 to the plate 70 as described above.

A second alternative structure of the wicking device is a porous pad that is used to provide a fluid path between the bottle 50 and a dispensing position within the stream of flush water. The porous pad has the same overall shape as the wicking device 60 that is illustrated in FIGS. 1–18, with elongate guide slots that provide adjustability of position of the pad. In this configuration, liquid 58 flows out of the bottle 58, into the feed conduit 34 of the base 20, through the outlet portion 38 and onto the porous pad. The liquid then continues to move toward the outer end of the porous pad by capillary action where the liquid is mixed with flush water as described above.

The dispenser 10 and the dispenser 10*a* have many advantages. One advantage can be understood by looking at FIG. 15 which shows dispenser 10 installed on a toilet rim 16*b*. It can be seen that the stream of flushing water, indicated by the arrow W, will contact the extension plate 80 of the dispenser 10 during a toilet flush because the extension plate 80 is dimensioned such that the extension plate 80 is positioned within the flow of water during a toilet flush, and in this example, is positioned in contact with an inner wall 17 of the toilet bowl 14*b*. The extension plate 80 then directs the flush water onto the outer end of the wicking device 60. The liquid 58 on the wicking device 60 is mixed with flush water, and a mixture including flush water and liquid 58 is then distributed into the toilet. If the extension plate 80 were not included in the dispenser 10, the flush water would bypass the dispensing plate 60 and little or no liquid 58 would be distributed into the toilet. Likewise, if the extension plate 80*a* were not included in the dispenser 10*a*, the flush water would bypass the dispensing plate 60 and little or no liquid 58 would be distributed into the toilet (see FIG. 17). Optionally, the extension plates 80 and 80*a* may include an upwardly extending rim at a perimeter thereof to further optimize the flush water collection and distribution functions of the extension plates 80 and 80*a*.

Another advantage of the dispenser 10 and the dispenser 10*a* can be understood by looking at FIG. 14 which shows dispenser 10 installed on a toilet rim 160. It can be seen that the extension plate 80 is dimensioned and secured to the wicking device 60 such that the wicking device 60 is inclined downwardly with respect to an inner wall 15 of the toilet bowl 140 when the dispenser 10 is installed on the rim 160 of the toilet bowl 140. One way the inclination of the wicking device 60 can be achieved is by configuring the extension plate 80 such that the extension plate 80 is fixed against rotational movement with respect to the wicking device 60 when the extension plate 80 is secured to the wicking device 60. The channel 81 in the extension plate 80 described above is one such configuration. In this configuration of the extension plate 80, the extension plate 80 is fixedly positioned in the same plane as the wicking device 60 and is removable from the wicking device 60 by movement in the same plane as the wicking device 60. The downward inclination of the wicking device 60 serves to improve the fluid delivery performance of the dispenser 10 when installed on a toilet rim. Likewise, FIG. 16 shows that the wicking device 60 is inclined downwardly with respect to the inner wall 15 of the toilet bowl 140 when the dispenser 10*a* is installed on the rim 160 of the toilet bowl 140. The downward inclination of the wicking device 60 serves to improve the fluid delivery performance of the dispenser 10*a* when installed on a toilet rim.

The removable aspect of the extension plates 80 and 80*a* also provides advantages. When installing the dispenser 10 on certain toilets, the wicking device 60 will be in the flow of flush water during a toilet flush, and preferably will even be downwardly inclined with respect to the inner wall of the toilet rim. In this case, the extension plate 80 can be removed from the dispenser 10 and the dispenser 10 can be used without any water flow alteration such as that which may occur with prior under the toilet rim liquid cleansing and/or freshening devices that include non-removable water deflection elements. When the dispenser 10 is installed on a toilet and the wicking device 60 is not in the flow of flush water during a toilet flush, the extension plate 80 can be installed on the dispenser 10 to direct flush water on the wicking device 60 as described above. Also, when the dispenser 10 is installed on a toilet and the wicking device 60 is not inclined with respect to an inner wall of the toilet bowl, the extension plate 80 can be installed on the dispenser 10 to provide a downward inclination to the wicking device 60, if desired. The installation of the extension plate 80*a* on the dispenser 10*a* provides identical results.

Thus, there has been provided a device for dispensing liquid toilet bowl treatment preparations, such as cleaning and freshening liquids, from under the rim of a toilet bowl by way of the flow of water during a toilet flush. The dispensing device includes an extension plate that may be added to the device such that the toilet flush water may be collected and directed over a dispensing plate regardless of the toilet configuration thereby effectively washing the cleaning and freshening liquids off the dispensing plate and into the toilet bowl. The extension plate may be added to the device such that the dispensing plate is inclined downwardly toward the inner wall of the toilet bowl when installed on the toilet rim thereby optimizing the fluid delivery performance of the device. The under the toilet rim liquid cleansing and/or freshening device includes an extension plate that may be added to the device such that the device may work effectively in the vast majority of toilets marketed worldwide.

Although the present invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

Industrial Applicability

The invention may be used for dispensing liquids, such as cleaning and freshening liquids, from under the rim of a toilet bowl by way of the flow of water during a toilet flush.

We claim:

1. A dispensing device for using a flow of water during a toilet flush to dispense liquid toilet bowl treatment preparations into a toilet bowl, the device comprising:

a bottle for holding a liquid, the bottle having a mouth and a closure for covering the mouth;

a base for holding the bottle, the base having a piercing post, the piercing post being suitable for opening the closure of the bottle;

suspension means for suspending the base from a rim of the toilet bowl;

a wicking device supported by the base, the wicking device being suitable to convey the liquid from the piercing post to a dispensing portion on the wicking device; and an extension plate removably secured to the wicking device, the extension plate being dimensioned such that the extension plate is positioned within the flow of water during a toilet flush and such that at least a portion of the flow of water is directed onto the dispensing portion of the wicking device during a toilet flush, wherein the extension plate includes an upwardly extending rim at a perimeter thereof, the rim being present on opposed sides of the extension plate.

2. The dispensing device of claim 1, wherein the extension plate is secured to the wicking device by a snap fit engagement.

3. The dispensing device of claim 1, wherein the extension plate is secured to the wicking device by inserting an edge of the wicking device in a channel in an inner wall of the extension plate.

4. The dispensing device of claim 1, wherein the extension plate is dimensioned and secured to the wicking device such that the wicking device is inclined downwardly with respect to an inner wall of the toilet bowl when the device is installed on the rim of the toilet bowl.

5. The dispensing device of claim 1, wherein the extension plate is fixed against rotational movement with respect to the wicking device when secured to the wicking device.

6. The dispensing device of claim 1, wherein the extension plate is fixedly positioned in the same plane as the wicking device.

7. The dispensing device of claim 1, wherein the wicking device comprises a dispensing plate having an upper surface including at least one feed channel in fluid communication with the piercing post of the base.

8. The dispensing device of claim 1, wherein the wicking device comprises a plate with holes formed therein.

9. The dispensing device of claim 1, wherein the wicking device comprises a porous pad.

10. A dispensing device for using a flow of water during a toilet flush to dispense liquid toilet bowl treatment preparations into a toilet bowl, the device comprising:

a bottle for holding a liquid, the bottle having a mouth and a closure for covering the mouth;

a base for holding the bottle, the base having a piercing post, the piercing post being suitable for opening the closure of the bottle;

suspension means for suspending the base from a rim of the toilet bowl;

a wicking device supported by the base, the wicking device being suitable to convey the liquid from the piercing post to a dispensing portion on the wicking device; and an extension plate removably secured to the base, the extension plate being dimensioned such that the extension plate is positioned within the flow of water during a toilet flush and such that at least a portion of the flow of water is directed onto the dispensing portion of the wicking device during a toilet flush, wherein the extension plate includes an upwardly extending rim at a perimeter thereof, the rim being present on opposed sides of the extension plate.

11. The dispensing device of claim 10, wherein the extension plate is secured to the base by a snap fit engagement.

12. The dispensing device of claim 10, wherein the extension plate is secured to the base by inserting an edge of the base in a channel in an inner wall of the extension plate.

13. The dispensing device of claim 10, wherein the extension plate is dimensioned and secured to the base such that the wicking device is inclined downwardly with respect to an inner wall of the toilet bowl when the device is installed on the rim of the toilet bowl.

14. The dispensing device of claim 10, wherein the extension plate is fixed against rotational movement with respect to the base when secured to the base.

15. The dispensing device of claim 10, wherein the extension plate is fixedly positioned in the same plane as the wicking device.

16. The dispensing device of claim 10, wherein the wicking device comprises a dispensing plate having an upper surface including at least one feed channel in fluid communication with the piercing post of the base.

17. The dispensing device of claim 10, wherein the wicking device comprises a plate with holes formed therein.

18. The dispensing device of claim 10, wherein the wicking device comprises a porous pad.

* * * * *